United States Patent [19]

Henneken et al.

[11] Patent Number: 4,878,655

[45] Date of Patent: Nov. 7, 1989

[54] FURNACE CHARGING THROAT CONSTRUCTION

[75] Inventors: Bernhard Henneken, Oberhausen; Bruno Kämmerling, Dinslaken; Eckhard-K. Scholz, Bottrop; Wolfgang Schröder, Oberhausen; Hans Krause, Moers, all of Fed. Rep. of Germany

[73] Assignee: Man Gutehoffnungshuette, GmbH, Fed. Rep. of Germany

[21] Appl. No.: 100,526

[22] Filed: Sep. 24, 1987

[30] Foreign Application Priority Data

Sep. 26, 1986 [DE] Fed. Rep. of Germany ..... 3632724

[51] Int. Cl.[4] ..... C21B 7/18

[52] U.S. Cl. ..... 266/184; 414/203

[58] Field of Search ..... 266/184; 414/203

[56] References Cited

U.S. PATENT DOCUMENTS 3,695,466 10/1972 Sugawara et al. ..... 414/203
4,307,987 12/1981 Legille et al. ..... 414/205

FOREIGN PATENT DOCUMENTS 721977 10/1968 Belgium .
1036292 8/1958 Fed. Rep. of Germany .
1433388 9/1970 Fed. Rep. of Germany .
1433322 11/1971 Fed. Rep. of Germany .

*Primary Examiner*—Melvyn J. Andrews
*Attorney, Agent, or Firm*—McGlew & Tuttle

[57] ABSTRACT

In a throat stopper for shaft furnaces, in particular blast furnaces with two hoppers of which an upper hopper is rotatable through a drive device, the upper hopper is designed, by means of a stationary hood equipped with charging flap valves, as a sluice chamber to be closed pressureproof. For sealing the stationary hood relative to the rotatable upper hopper, there is disposed, at the hood, a peripheral flexible inflatable bellows. The bellows can be pressed against the wall of the upper hopper pneumatically or hydraulically. While material is being charged in the upper hopper, one of the charging valves is open and the bellows is pressureless. During, or shortly thereafter, the charging, the upper hopper is rotated. For during the lower hopper, the valves of the upper hopper are closed, bellows is inflated, and the upper hopper is hopper are closed, bellows is inflated, and the upper sluice chamber is pressurized.

5 Claims, 2 Drawing Sheets

FURNACE CHARGING THROAT CONSTRUCTION

BACKGROUND OF THE INVENTION

Field of the Invention

The invention relates to a furnace charging construction and in particular to a new and useful throat stopper for shaft furnaces, in particular blast furnaces with two hoppers, of which the upper hopper is rotatable via a drive device and to a method of operating the furnace charger.

Most of the known devices for introducing and distributing the charges for the burdening of blast furnaces are built on what is called the McKee principle. In this arrangement with two bells, a large bell in the lower region and a smaller bell in the upper region, the two bells being arranged one above the other, the upper hopper is rotatable.

the McKee throat stopper has the advantage, among others, that its overall height is relatively small, an advantage which is significant with respect to maintaining the lumpiness of the charged material. A disadvantage of this type of stopper, which may be termed a single-chamber stopper because the upper hopper is not form ed as a sluice chamber, consists in that the sealing of the lower distributor bell relative to the sluice chamber wall constitutes a problem in particular because of the relatively large seal elements. This seal is, for one thing, under heavy stress due to wear by the abrasive charge material, but, for another, it is also problematical because of possible deformations due to uneven gas temperature distribution over the cross section of the furnace. As soon as a leak occurs at any point of the seal, dust particles are entrained with the outflowing gases due to the high pressure in this zone, and they will very soon increase the leaks. This source of dust constitutes an unacceptable environmental pollution, not to mention the fact that the seal elements must be replaced frequently.

To remedy this situation, it has been proposed before to design a throat stopper of this kind in such a way that the lower large bell need no longer from a gasproof seal. This is done in that the rotary distributor closed by the bell is disposed in a tightly closed envelope.

SUMMARY OF THE INVENTION

The invention provides a furnace charging double-sluice throat stopper construction where the problem of the seal between the lower distribution bell and the lower sluice chamber can be neglected but the advantages of the known throat stopper with regard to a low overall height are preserved.

The invention adopts means different from the above mentioned known improvement. According to the present invention, the upper hopper is designed as a pressure-proof sluice chamber comprising a pressure-proof stationary hood placed on a rotary hopper.

The throat stopper according to the invention has a low overall height. This means a low height of fall for the charge material (coke, cinders, pellets, etc.) and, resulting therefrom, a small fines fraction of the charge material.

The seal problems no longer have the previously mentioned significance because with the double sluice, according to the invention, it is not possible that solids-laden gases are forced out of the blast furnace throat via the throat stopper into the atmosphere in an uncontrolled manner.

With the arrangement according to the invention, when the upper sluice chamber is placed under positive pressure for charging the lower sluice chamber, the inflated bellows at the hood of the upper sluice hopper presses against the sluice chamber wall and provides for an absolute pressure-proof charging device. In accordance with the automatic charging program, the upper sluice hopper rotates during, or shortly after, the filling with the charging valve open and with the upper sluice chamber pressure-less.

Accordingly, it is an object of the invention to provide a charging throat stopper construction for furnaces which includes a stationary hood and an upper sluice hopper portion which is rotatably mounted below the hood and sealable thereto and which is driven by a drive connected thereto and which is equipped with at least one flap valve for opening and closing the chamber, said hopper having means for closing it so that it is pressure-tight.

A futher object of the invention is to provide a furnace with a throat head entrance design for charging it which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
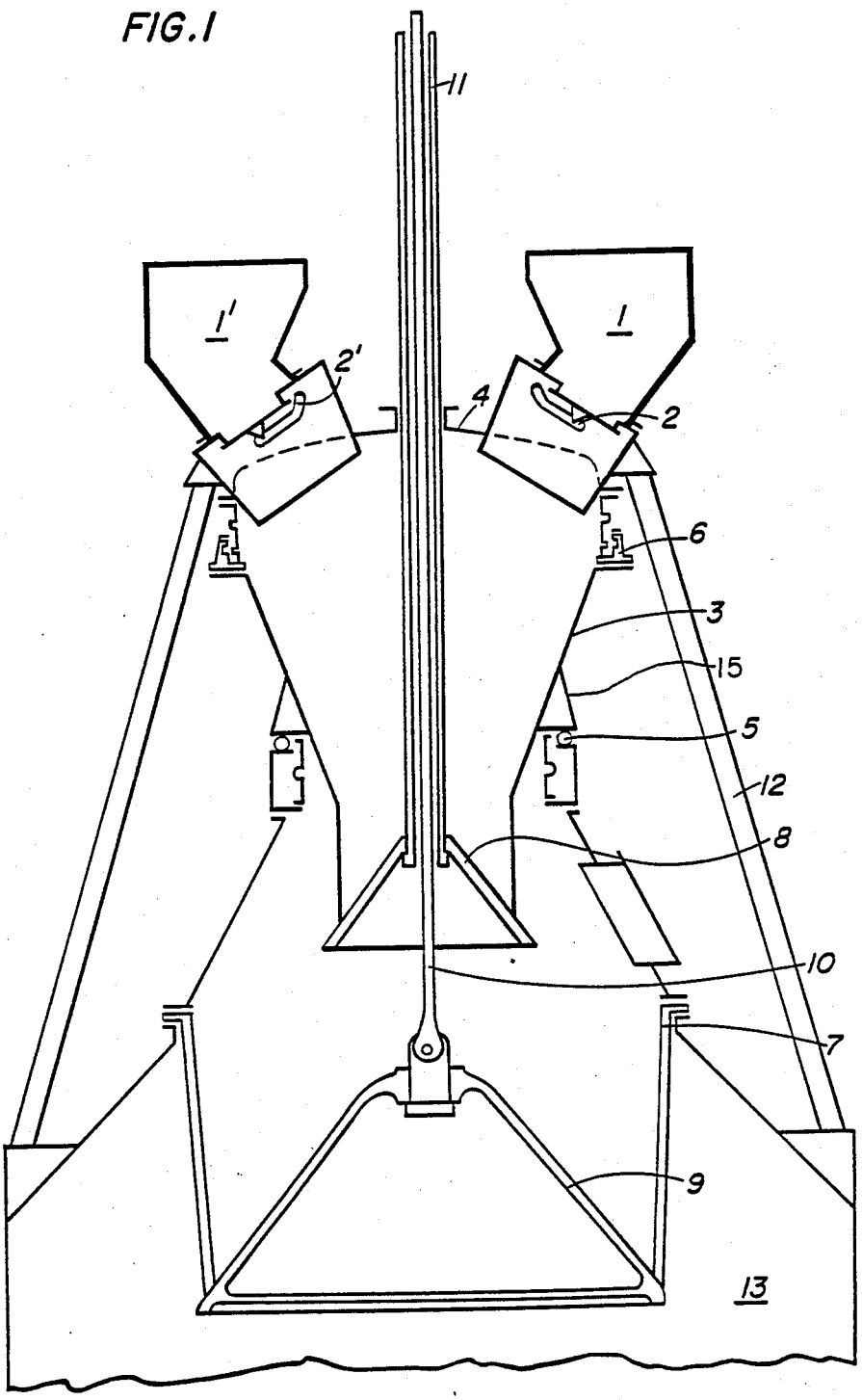
FIG. 1 is a transverse section through a furnace charging double-sluice throat stopper constructed in accordance with the invention.

Referring to the drawings, in particular, the invention embodied therein comprises a furnace charging double-sluice throat stopper construction, particularly for blast furnaces which includes a stationary hood 4 which carries two charging chutes 1, 1 each having a closeable charging flap valve 2. The hood 4 and the chutes 1 are supported at a fixed elevation on struts 12.

In accordance with the invention, an upper sluice hopper 3 is rotatably mounted below the hood 4 in a position in which it can be sealed to the hood by sealing means 6 which can be applied or released and which, in the embodiment shown, comprises inflatable bellows. The feature of the construction is that the upper sluice hopper 3 is rotated by means of a drive 5 having associated rotation support above a lower slice hopper 7.

FIG. 1 shows the upper region 13 of the blast furnace, called a blast furnace throat, with a furnace charging double-sluice throat stopper 15 construction disposed thereabove. The double-sluice throat stopper construction 15 comprises charging chute 1 and 1' charging flap valves 2, 2' of a stationary hood 4. The throat stopper also includes an upper sluice hopper 3 with a distributor bell 8, and a lower sluice hopper 7 with a distributor bell 9.

The upper sluice hopper 3 can be set in rotation by a drive 5.

Figure 2:
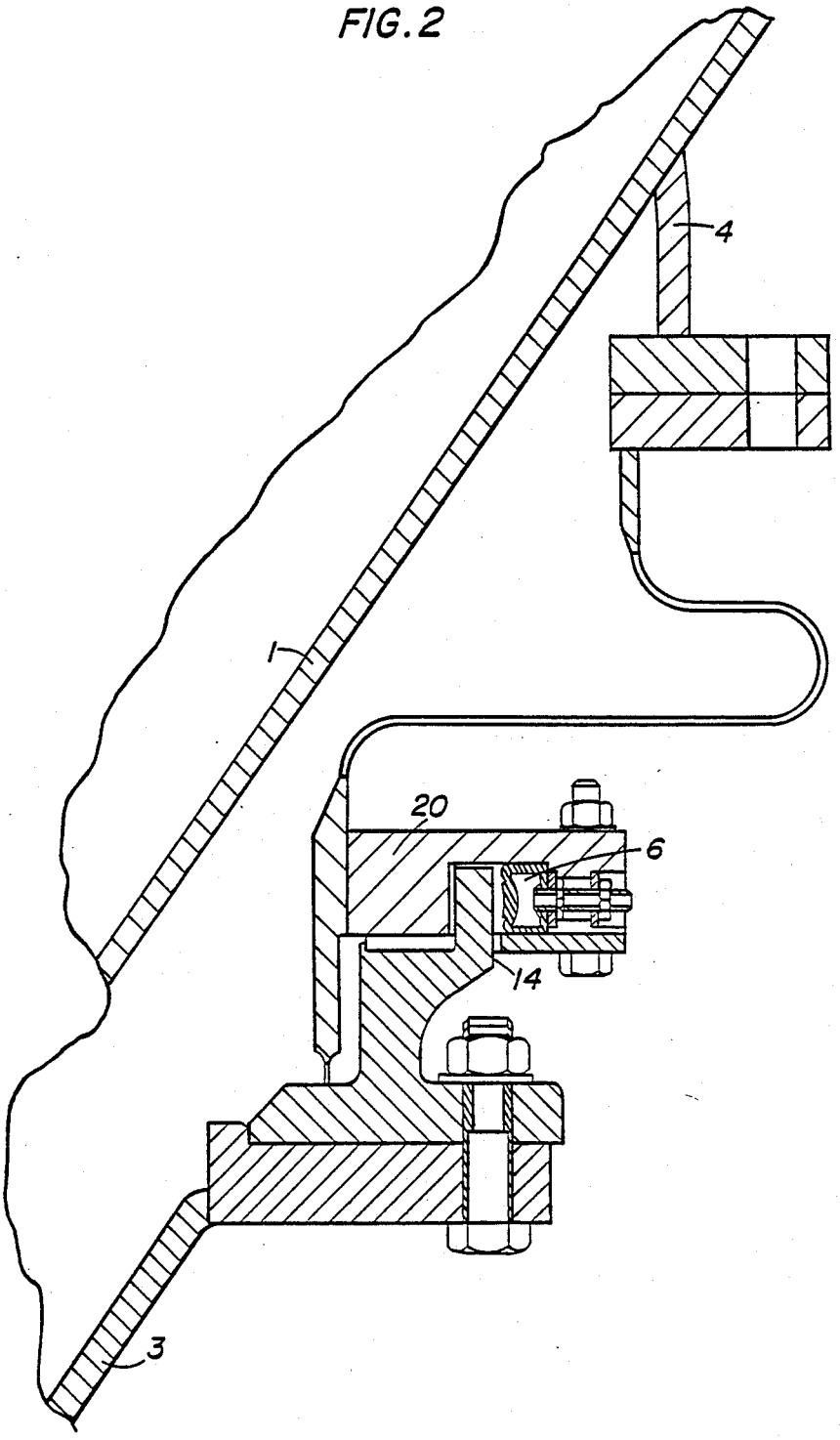
FIG. 2 is a detailed sectional view on a larger scale showing the seal between stationary hood and upper sluice hopper by a flexible, inflatable balloon.

The stationary hood 4 is sealed relative to the upper rotatable sluice hopper 3 according to FIG. 2 by means of a peripheral flexible bellows 6. This bellows can be inflated pneumatically or hydraulically and, in the inflated state, it applies at 14 against the wall of the upper sluice hopper 3 and against a flange 20 on the hood 4.

FIG. 2 shows the bellows 6 in the pressureless state. The lower part of the hood 4 is compensatory in design.

When, for charging the lower sluice hopper 7, the upper sluice hopper 3 is set under positive pressure, the charging flap valves 2 are closed and the bellows 6 is inflated. The distributor bell 8 is raised on the vertical pipe member 11, while the raised distributor bell 9 is in a closed position.

For charging the upper sluice hopper 3, one of the charging valves 2 is, as a rule, open, the bellows 6 is pressureless, and the distribution bell 8 is closed against the bottom of the upper sluice hopper 3.

During the charging of the upper sluice hopper 3 or shortly after the filling, the upper sluice hopper 3 is set in rotation by means of the drive 5.

Opening of the distributor bell 9 by lowering the rod 10 takes place with the distributor bell closed.

While specific embodiments of the invention have been shown and described in detail to illustrate the application of the principles of the invention, it will be understood that the invention may be embodied otherwise without departing from such principles.

What is claimed is:

1. A furnace charging double-sluice throat stopper construction comprising a stationary hood, an upper sluice hoppr rotatably mounted below and sealable with said hood, drive meanns connected to said upper sluice hopper for rotating said upper sluice hopper around a substantially vertical axis below said hood, at least one charging chute mounted on said hood and opening into said hood and having a lower end entering into said hood with at least one charging flap valve, and means for pressure-sealing said upper sluice hopper in respect to said hood and a lower sluice hopper arranged for charging by said upper sluice hopper.

2. A furnace charging double-sluice throat stopper construction according to claim 1, wherein said sealing means comprises an expandable bellows, means mouting said bellows in a position between said hood and said upper sluice hopper to apply a pressure-sealing engagement of said bellows when in expanded condition to effect a sealing therebetween.

3. A furnace charging double-sluice throat stopper construction according to claim 2, wherein said bellows is pneumatically inflatable.

4. A furnace charging double-sluice throat stopper construction according to claim 1, wherein said sealing means comprises a hydraulically expandable bellows.

5. A furnace charging double-sluice throat stopper construction according to claim 1, wherein the lower sluice hopper is positioned below said upper sluice hopper, a vertical pipe member is journaled in said hood for movement upwardly and downwardly through said upper sluice hopper and having a distributor bell at its lower end which is engageable with a lower end of said upper sluice hopper to close it and is movable downwardly from said upper sluice hopper to open said upper sluice hopper, a rod member being movable upwardly and downwardly within said vertical pipe member and having a lower end below the distributor bell at the lower end of the upper sluice hopper and terminating in a distributor bell for the lower sluice hopper engageable with a lower end of said lower sluice hopper and movable outwardly therefrom to open said lower sluice hopper.

* * * * *